US005845905A

United States Patent [19]

Stevens

[11] Patent Number: 5,845,905

[45] Date of Patent: Dec. 8, 1998

[54] ALPHABET SOLITARY GAME

[76] Inventor: Patti Jo Stevens, 4580 Broadway Apt 6-S, New York, N.Y. 10040

[21] Appl. No.: 916,503

[22] Filed: Aug. 22, 1997

[51] Int. Cl.[6] ..... A63F 1/00

[52] U.S. Cl. ..... 273/272; 273/299

[58] Field of Search ..... 273/272, 299

[56] References Cited

U.S. PATENT DOCUMENTS

| | | | |
|---|---|---|---|
| 3,165,318 | 1/1965 | Lissandrello | 273/272 |
| 5,199,714 | 4/1993 | Harper | 273/299 |
| 5,556,102 | 9/1996 | Huang | 273/299 |

*Primary Examiner*—William M. Pierce

[57] ABSTRACT

An alphabet solitary game is provided including a game board having an upper surface with a row of vowel squares each having a unique alphabetic vowel character printed therein. Further provided is plurality of cards each having a single alphabetic character printed thereon. Prior to play, a card is placed within each of the vowel squares such that an alphabetic character of each card matches the alphabetic vowel character of the associated one of the vowel squares of the game board. Thereafter, a card is situated face up in a square matrix on the game board. During play, a single player takes turns during which the single player attempts to form a word with at least a predetermined amount of cards. Each turn may comprise the step of picking any of the vowel cards in the vowel squares and utilizing the vowel card in the word of the turn. Finally, the player is declared a winner upon the picking of all the cards in the square matrix.

4 Claims, 2 Drawing Sheets

ALPHABET SOLITARY GAME

BACKGROUND OF THE INVENTION

1. Field of the Invention

The present invention relates to a alphabet solitary game and more particularly pertains to providing a word game for use by a single player.

2. Description of the Prior Art

The use of alphabet games is known in the prior art. More specifically, alphabet games heretofore devised and utilized for the purpose of providing entertainment are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,420,157; U.S. Pat. No. 4,341,387; U.S. Pat. Des. No. 351,003; U.S. Pat. No. 4,350,342; U.S. Pat. No. 5,314,191; and U.S. Pat. No. 4,923,199.

In this respect, the alphabet solitary game according to the present invention substantially departs from the conventional concepts and designs of the prior art, and in so doing provides an apparatus primarily developed for the purpose of providing a word game for use by a single player.

Therefore, it can be appreciated that there exists a continuing need for a new and improved alphabet solitary game which can be used for providing a word game for use by a single player. In this regard, the present invention substantially fulfills this need.

SUMMARY OF THE INVENTION

In view of the foregoing disadvantages inherent in the known types of alphabet games now present in the prior art, the present invention provides an improved alphabet solitary game. As such, the general purpose of the present invention, which will be described subsequently in greater detail, is to provide a new and improved alphabet solitary game which has all the advantages of the prior art and none of the disadvantages.

To attain this, the present invention essentially comprises a game board with a square configuration. Such game board has an upper surface, a lower surface and a periphery defined by a top edge, a bottom edge, a left edge, and a right edge. In use, the game board is adapted to fold in half along a crease formed between a central extent of the left edge and right edge. As shown in FIG. 3, the upper surface of the game board having a row of four blank squares situated adjacent the top edge and left edge thereof. Situated adjacent the top edge and right edge of the game board is a row of vowel squares each having a unique alphabetic vowel character printed therein. A column of three blank squares are situated adjacent a central extent of the right edge. Further provided is a plurality of cards each having a single alphabetic character printed thereon. For reasons that will become apparent hereinafter, the cards further include three cards that are blank.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved alphabet solitary game which has all the advantages of the prior art alphabet games and none of the disadvantages.

It is another object of the present invention to provide a new and improved alphabet solitary game which may be easily and efficiently manufactured and marketed.

It is a further object of the present invention to provide a new and improved alphabet solitary game which is of a durable and reliable construction.

An even further object of the present invention is to provide a new and improved alphabet solitary game which is susceptible of a low cost of manufacture with regard to both materials and labor, and which accordingly is then susceptible of low prices of sale to the consuming public, thereby making such alphabet solitary game economically available to the buying public.

Still yet another object of the present invention is to provide a new and improved alphabet solitary game which provides in the apparatuses and methods of the prior art some of the advantages thereof, while simultaneously overcoming some of the disadvantages normally associated therewith.

Still another object of the present invention is to provide a word game for use by a single player.

Lastly, it is an object of the present invention to provide a new and improved solitary game is provided including a game board having an upper surface with a row of vowel squares each having a unique alphabetic vowel character printed therein. Further provided is plurality of cards each having a single alphabetic character printed thereon. Prior to play, a card is placed within each of the vowel squares such that an alphabetic character of each card matches the alphabetic vowel character of the associated one of the vowel squares of the game board. Thereafter, a card is situated face up in a square matrix on the game board. During play, a single player takes turns during which the single player attempts to form a word with at least a predetermined amount of cards. Each turn may comprise the step of picking any of the vowel cards in the vowel squares and utilizing the vowel card in the word of the turn. Finally, the player is declared a winner upon the picking of all the cards in the square matrix.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
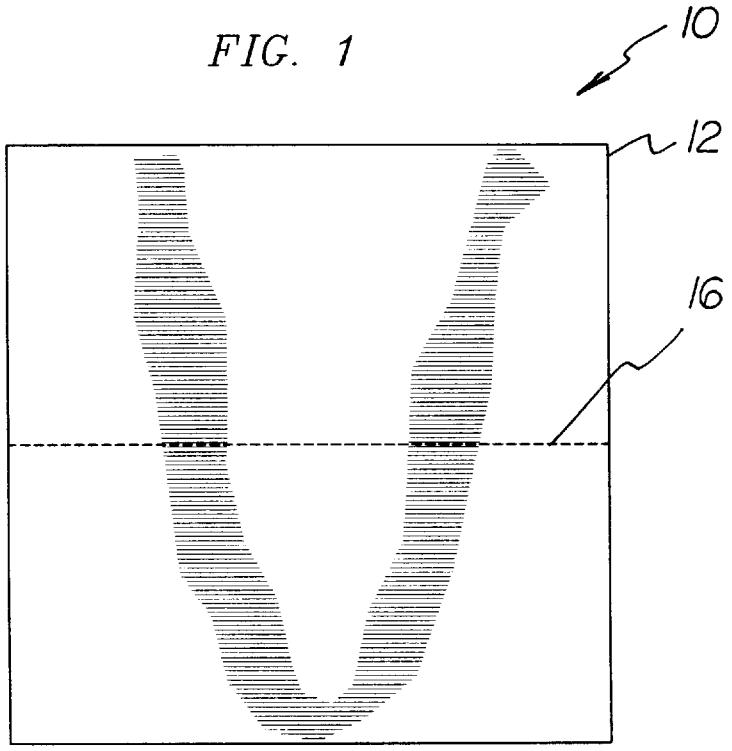
FIG. 1 is an illustration of the preferred embodiment of the alphabet solitary game constructed in accordance with the principles of the present invention.
Figure 2:
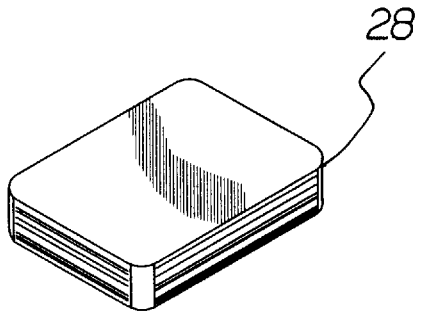
FIG. 2 is a perspective view of the cards in a stacked orientation.

With reference now to the drawings, and in particular to FIG. 1 thereof, a new and improved alphabet solitary game embodying the principles and concepts of the present invention and generally designated by the reference numeral 10 will be described.

The present invention, the new and improved alphabet solitary game, is comprised of a plurality of components. Such components in their broadest context include a game board and alphabet cards. Such components are individually configured and correlated with respect to each other so as to attain the desired objective.

More specifically, it will be noted that the system 10 of the present invention includes a game board 12 with a square configuration. Such game board has an upper surface, a lower surface and a periphery defined by a top edge, a bottom edge, a left edge, and a right edge. In use, the game board is adapted to fold in half along a crease 16 formed between a central extent of the left edge and right edge.

Figure 3:
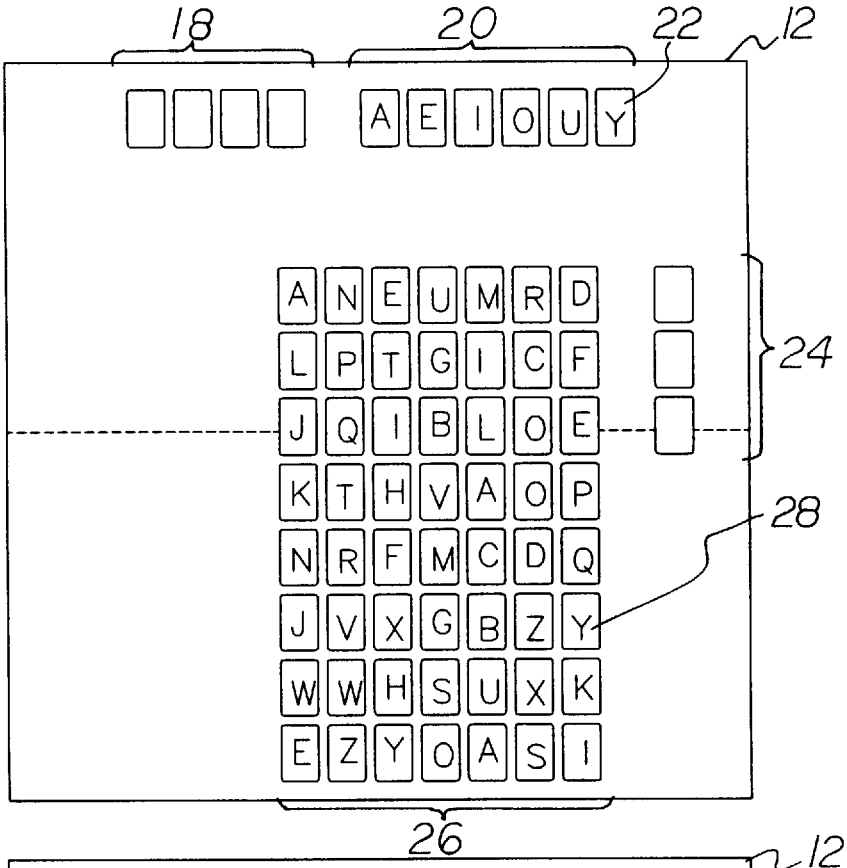
FIG. 3 is a top view of the game board of the present invention prior to play.
Figure 4:
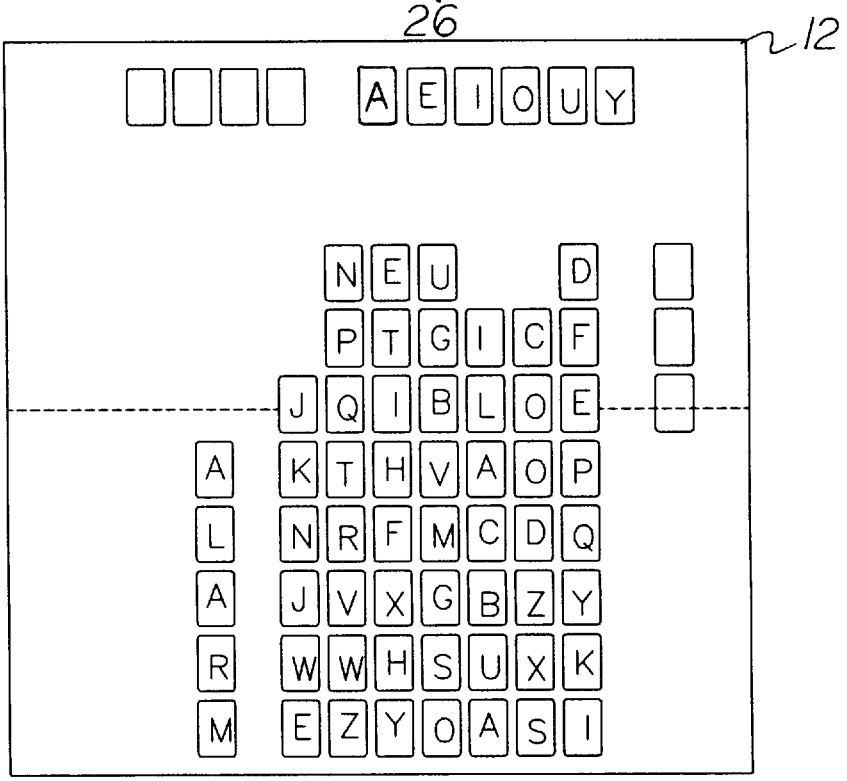
FIG. 4 is another top view of the game board of the present invention during use.

As shown in FIG. 3, the upper surface of the game board having a row of four blank squares 18 situated adjacent the top edge and left edge thereof. Situated adjacent the top edge and right edge of the game board is a row of vowel squares 20 each having a unique alphabetic vowel character 22 printed therein. Preferably, each of the vowels are represented in the vowel squares. A column of three blank squares 24 is situated adjacent a central extent of the right edge.

Further provided is a plurality of cards 28 each having a single alphabetic character printed thereon. Preferably, the cards have a two of each alphabetic character and extra vowels. For reasons that will become apparent hereinafter, the cards further include three cards that are blank.

The method associated with play of the present invention will now be described. First, the cards are shuffled and a card is placed face up within each of the vowel squares such that an alphabetic character of each card matches the alphabetic vowel character of the associated one of the vowel squares of the game board. As an option, the vowel square may be left blank and the user may simply line up the vowel cards on the board. Next, a plurality of cards are placed face up to form a square matrix of 8 rows and 7 columns on the game board. Thereafter, the blank cards are situated in the column of three blank squares of the game board.

At this point, the game board is ready for play. During play, a single player continues to take consecutive turns.

During each turn, the single player attempts to form a word with at least three cards, excluding a proper name and location. Such word may be formed in one of various ways following various rules. For example, any of the cards of the square matrix may be picked and utilized in the word of the turn. Further, the player may place up to three unused cards in the row of four blank squares without ramifications. If four cards are present in the four blank squares, however, the cards in such squares must be utilized during the next turn to free up the squares. If the cards can not be utilized, the player automatically loses.

Further, the player may pick any of the vowel cards in the vowel squares and utilize the same in the word being formed during the turn. It should be noted that such option is only available after three turns from the start of the game. Yet another option open to the player is to pick and utilize the blank cards as any one letter in the word of the turn. It is imperative that the player not be allowed to change a word from a previous turn. Further, the player may only use a word once.

It should be noted that the player is declared a winner upon the picking of all the cards in the square matrix and the forming of words therewith.

Various rules may be changed to make the game of the present invention more difficult. For example, time limits may be employed, the additional vowel cards and blank cards may not be used, the minimum number of letters in each turn may be raised, and further words may be formed with only one vowel. Further options include having two players play coincidentally, wherein the players race.

In an alternate embodiment, the method of the present invention may be carried out without the use of the game board.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved alphabet solitary game comprising, in combination:

a game board with a square configuration, the game board having an upper surface, a lower surface and a periphery defined by a top edge, a bottom edge, a left edge, and a right edge, the upper surface of the game board having a row of blank squares, a row of vowel squares each having a unique alphabetic vowel character printed therein, and a column of blank squares; and a plurality of cards each having a single alphabetic character printed thereon with the exception of a predetermined amount of the cards that are blank.

2. A method of playing an alphabet solitary game including the steps of:

providing a plurality of cards each having a single alphabetic character printed thereon, wherein some of the cards have vowels thereon;

shuffling the cards;

placing cards with vowels printed thereon in a row;

placing a plurality of cards face up in a matrix;

taking a plurality of turns during which a single player picks cards from the matrix and attempts to form a word with at least a predetermined amount of cards, wherein at least one of the turns comprises the step of picking any of the vowel cards of the row and utilizing the vowel card in the word of the turn; and declaring the player a winner upon the picking of all the cards in the square matrix.

3. A method of playing an alphabet solitary game as set forth in claim 2 and further including the step of providing a plurality of blank cards, wherein at least one of the turns comprises the step of picking a blank card and utilizing the blank card in the word of the turn with the blank card representative of any one of the alphabetic characters.

4. A method of playing an alphabet solitary game including the steps of:

providing a game board with a square configuration, the game board having an upper surface, a lower surface and a periphery defined by a top edge, a bottom edge, a left edge, and a right edge, the game board adapted to fold in half along a crease formed between a central extent of the left edge and right edge, the upper surface of the game board having a row of four blank squares situated adjacent the top edge and left edge thereof, a row of vowel squares situated adjacent the top edge and right edge thereof and each having a unique alphabetic vowel character printed therein, and a column of three blank squares situated adjacent a central extent of the right edge;

providing a plurality of cards each having a single alphabetic character printed thereon with the exception of three of the cards that are blank;

shuffling the cards;

placing a card within each of the vowel squares such that an alphabetic character of each card matches the alphabetic vowel character of the associated one of the vowel squares of the game board;

placing a plurality of cards face up in a square matrix on the game board;

placing the blank cards in the column of three blank squares of the game board;

taking a plurality of turns during which a single player attempts to form a word with at least three cards, wherein the turns each include at least one of the following steps of:

placing unused cards in the row of four blank squares, picking any of the vowel cards in the vowel squares and utilizing the vowel card in the word of the turn, picking and utilizing the cards of the square matrix in the word of the turn, and picking and utilizing the blank cards as any one alphabetic character in the word of the turn; and declaring the player a winner upon the picking of all the cards in the square matrix.

* * * * *